United States Patent [19]

Richeson, Jr.

[11] Patent Number: 4,883,025

[45] Date of Patent: Nov. 28, 1989

[54] POTENTIAL-MAGNETIC ENERGY DRIVEN VALVE MECHANISM

[75] Inventor: William E. Richeson, Jr., Fort Wayne, Ind.

[73] Assignee: Magnavox Government and Industrial Electronics Company, Fort Wayne, Ind.

[21] Appl. No.: 153,262

[22] Filed: Feb. 8, 1988

[51] Int. Cl.[4] ..... F01L 9/06

[52] U.S. Cl. ..... 123/90.11; 251/48; 251/65; 251/129.1; 335/234; 361/194

[58] Field of Search ..... 123/90.11; 251/129.1, 251/48, 65; 335/234; 361/194, 192

[56] References Cited

U.S. PATENT DOCUMENTS

| | | | |
|---|---|---|---|
| 3,882,833 | 5/1975 | Longstaff et al. | 123/90.11 |
| 4,455,543 | 6/1984 | Pischinger et al. | 335/266 |
| 4,533,890 | 8/1985 | Patel | 335/234 |
| 4,749,167 | 6/1988 | Gottschall | 251/65 |
| 4,779,582 | 10/1988 | Lequesne | 251/129.1 |
| 4,831,973 | 5/1989 | Richeson, Jr. | 123/90.11 |

*Primary Examiner*—Andrew M. Dolinar

*Attorney, Agent, or Firm*—Roger M. Rickert; Thomas A. Briody; Richard T. Seeger

[57] ABSTRACT

A bistable electronically controlled transducer having an armature reciprocable between first and second positions is disclosed including either a stressed spring or compressed air within a closed chamber in the transducer for causing the armature to move, and a permanent magnet latching arrangement for holding the armature in either one of the positions. An electromagnetic arrangement for temporarily neutralizing the effect of the permanent magnet latching arrangement releases the armature to move from one to the other of the positions. The transducer finds particular utility as an actuator mechanism for moving internal combustion engine valves.

3 Claims, 5 Drawing Sheets

POTENTIAL-MAGNETIC ENERGY DRIVEN VALVE MECHANISM

The present invention relates generally to a two position, straight line motion actuator and more particularly to a fast acting actuator which utilizes potential energy against an armature to perform extremely fast transit times between the two positions.

This actuator functions as a bistable transducer and finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves.

The actuator mechanism may find numerous other applications such as in compressor valving and valving in other hydraulic or pneumatic devices, or as a fast acting control valve for fluidic actuators or mechanical actuators where fast controlled action is required such as moving items in a production line environment.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

In copending application Ser. No. 021,195 entitled Electromagnetic Valve Actuator, filed Mar. 3, 1967 and now U.S. Pat. No. 4,794,890 in the name of William E. Richeson and assigned to the assignee of the present application, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 153,257, entitled Pneumatic Electronic Valve Actuator, filed on even date herewith in the names of William E. Richeson and Frederick L. Erickson there is disclosed a somewhat similar valve actuting device which employs a release type mechanism rather than a repulsion scheme as in the previously identified copending application. The disclosed device in this application is a truly pneumatically powered valve with high pressure air supply and control valving to use the air for both damping and as the primary motive force. This application also discloses different operating modes including delayed intake valve closure and a six stroke cycle mode of operation.

Other related applications all assigned to the assignee of the present invention and filed on even data herewith are Ser. No. 153,154 (William E. Richeson) Repulsion Actuated Potential Energy Driven Valve Mechanism wherein a spring (or pneumatic equivalent) functions both as a damping device and as an energy storage device ready to supply part of the accelerating force to aid the next transition from one position to the other and Ser. No. 153,155 (William E. Richeson and Frederick L. Erickson) Pneumatically Powered Valve Actuator. One distinguishing feature of this last application is that control valves and latching plates have been separated from the primary working piston to provide both lower latching forces and reduced mass resulting in faster operating speeds. One distinguishing feature of the Repulsion Actuated Potential Energy Driven Valve Mechanism application is the fact that initial accelerating force is partly due to electromagnetic repulsion somewhat like that employed in the first abovementioned copending application.

In the first two referenced copending applications, numerous advantages and operating mode variations suitable for incorporation with the present valve actuator are disclosed and the entire disclosures of all four of these applications are specifically incorporated herein by reference.

Among the several objects of the present invention may be noted the provision of a valve actuating mechanism wherein potential energy is stored within the mechanism preparatory to subsequent actuation thereof; the provision of an electromagnetic latching device for an actuator which is unlatched by at least partially neutralizing a magnetic field; the provision of a compression (pneumatic or spring) driven valve actuating mechanism; the provision of a valve actuating mechanism of reduced inertia; The provision of a compact valve actuating mechanism; the provision of a bistable electronically controlled transducer which utilizes potential energy stored in the transducer from the previous transition from one stable state to the other to in part power the next transition; the provision of a valve actuating mechanism in accordance with the previous object which is more rapidly and easily accelerated and decelerated; and the provision of a simplistic hydraulic damper with lost motion coupling to a valve actuating device for slowing the motion of the valve actuating device near either extreme of its motion. These as well as other objects and advantages features of the present invention will be in part apparent and in part pointed out hereinafter.

In general, an electronically controllable valve mechanism for use in an internal combustion engine has an engine valve with an elongated valve stem and motive means, in the form of either a stressed spring or air compressed in a cavity, for causing the valve to move in the direction of stem elongation between valve-open and valve-closed positions along with a magnetic latching arrangement for holding the valve in each of the valve-open and valve-closed positions. A coil is energized to temporarily neutralize a magnetic field and release the magnetic latching arrangement allowing the motive means to move the valve.

Also in general and in one form of the invention, a bistable electronically controlled transducer has an armature reciprocable between first and second positions, a latching arrangement for maintaining the armature in one of said positions, and an electromagnetic arrangement operable when energized to at least partially neutralize the latching arrangement and dislodge the armature from the position in which the armature was maintained. The bistable electronically controlled transducer further includes an arrangement for continuously urging the armature away from the position in which it is maintained by the latching means. This urging may be due to a helical spring one portion of which is compressed and another portion of which is stretched in which case, the spring portion which was compressed becomes stretched and the spring portion which was stretched becomes compressed when the armature moves from one position to the other. The urging may also be pneumatic with the transducer including a housing, a piston coupled to the armature and air compressed by the piston within the housing.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
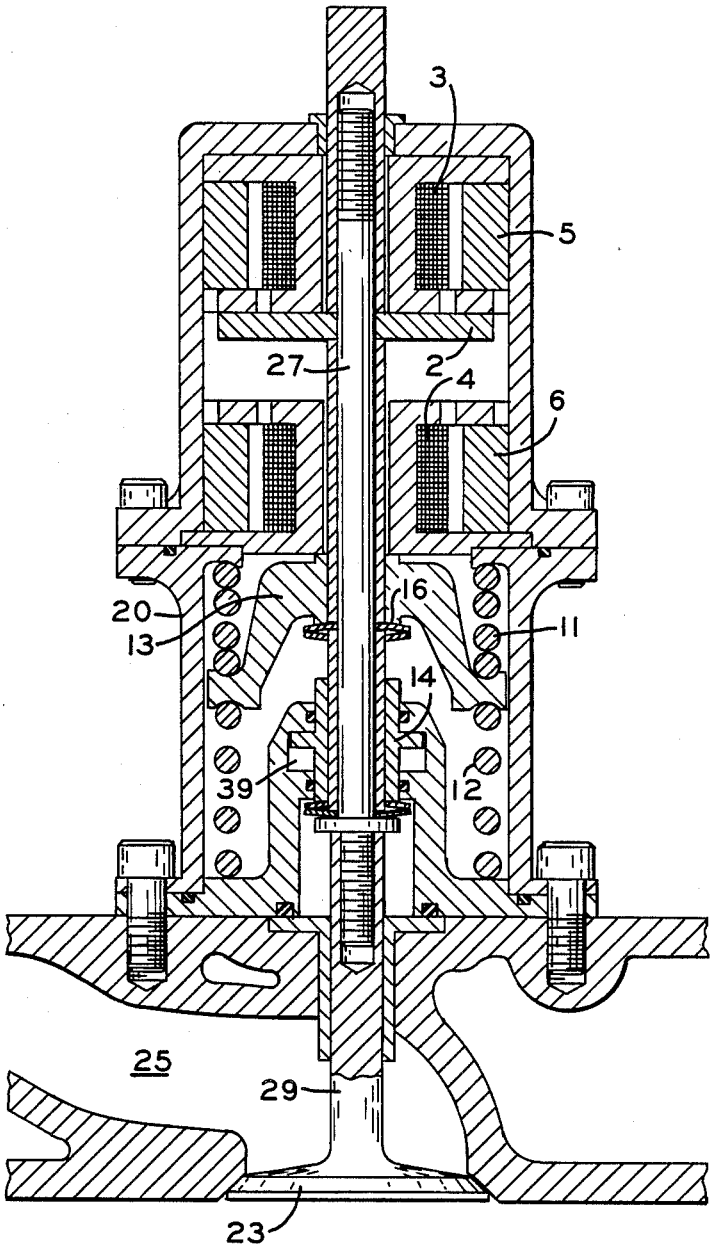
FIG. 1 is a view in cross-section of an engine valve and valve actuating mechanism in the valve-closed position.

FIG. 1 illustrates a conventional internal combustion engine poppet valve 23 for selectively opening communication between an engine cylinder and an intake or exhaust manifold 25. The valve is shown in FIG. 1 in its closed or full up and seated position. The valve actuator has a movable armature 27 reciprocable coaxially with valve stem 29 for opening and closing the valve. The armature includes a soft magnetic steel latching disk 2 which travels between latching magnets 5 and 6. The armature 27 is spring biased toward the neutral position of FIG. 2 by spring portions 11 and 12 and mechanically connected to those springs by a web or spindle 13. The spring portions 11 and 12 function as a means for continuously urging the armature 27 away from the position in which it is maintained by the latching magnets 5 as in FIG. 1 or 6 as in FIG. 3. The helical spring has one portion 11 compressed and another portion 12 which is stretched in FIG. 1 while the spring portion which was compressed becomes stretched and the spring portion which was stretched becomes compressed when the armature moves from the position of FIG. 1 to the position of FIG. 3.

Figure 6:
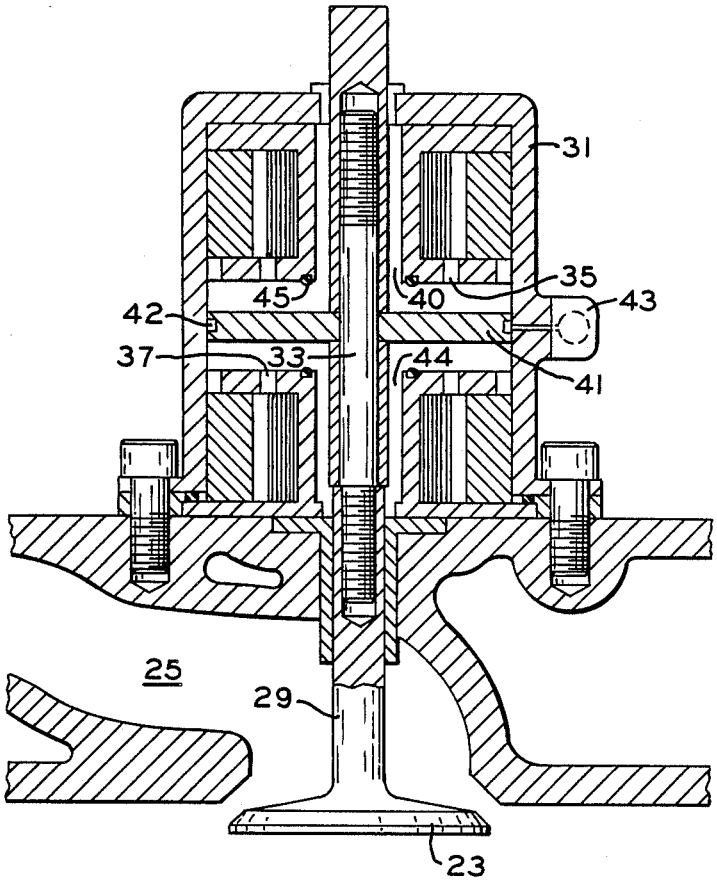
FIG. 6 illustrates a variation on the actuating mechanism of FIGS. 1–3.

The function of continuously urging the armature away from the position in which it is latched is provided in FIG. 6 by a housing 31, a piston 41 coupled to the armature 33 and air compressed by the piston within the housing in chamber 40 when the valve is closed and in chamber 44 when the valve is open. Piston 41 also provides a latching function similar to that provided by the plate 2 of FIGS. 1–3.

A damping piston 14 is coupled by a lost motion coupling to the armature 27 for rapidly decelerating the valve shaft toward the extremes of its travel by displacing fluid within the chamber 39.

A high latching force is provided by the attractive force of permanent magnet 5 on disk or plate 2 holding that plate in the up or valve-closed position. The same type latching is provided by permanent magnet 6 when holding disk 2 in the full down or valve-open position as shown in FIG. 3. The controlled release of one of the latches is achieved by injecting a neutralizing field in one of the coils 3 or 4 which are in juxtaposition with the permanent magnets 5 and 6 respectively. During operation, either coil may be energized to cancel the attraction of its associated magnet on the disk 2 freeing the disk and the armature to rapidly accelerate under the urging of the spring assembly 11 and 12 within the housing 20. As the armature passes the center or neutral position of FIG. 2, the spring assembly will begin to retard the velocity of the valve until the latching disk 2 comes into close proximity with the opposite latching magnet at which time the high attractive force of the magnet will overcome the deceleration force of the spring on the armature. This high magnetic attraction would cause a significant impact condition to occur between the latching disk 2 and the latching magnet if the velocity of the armature and valve was not substantially reduced by an independent damping device. The incorporation of damping provisions in the housing 20 will assure controlled deceleration and low impact velocity of the latching disk with the magnet.

It should also be noted that the two springs are nonlinear with the force increasing somewhat greater than linearly with increasing deflection to better match the spring forces to the nonlinear forces of attraction associated with the latching magnets. This nonlinear feature of the springs provides more rapid acceleration as well as deceleration to cause the valve to have a higher mean velocity and, hence, a shorter response time.

Figure 2:
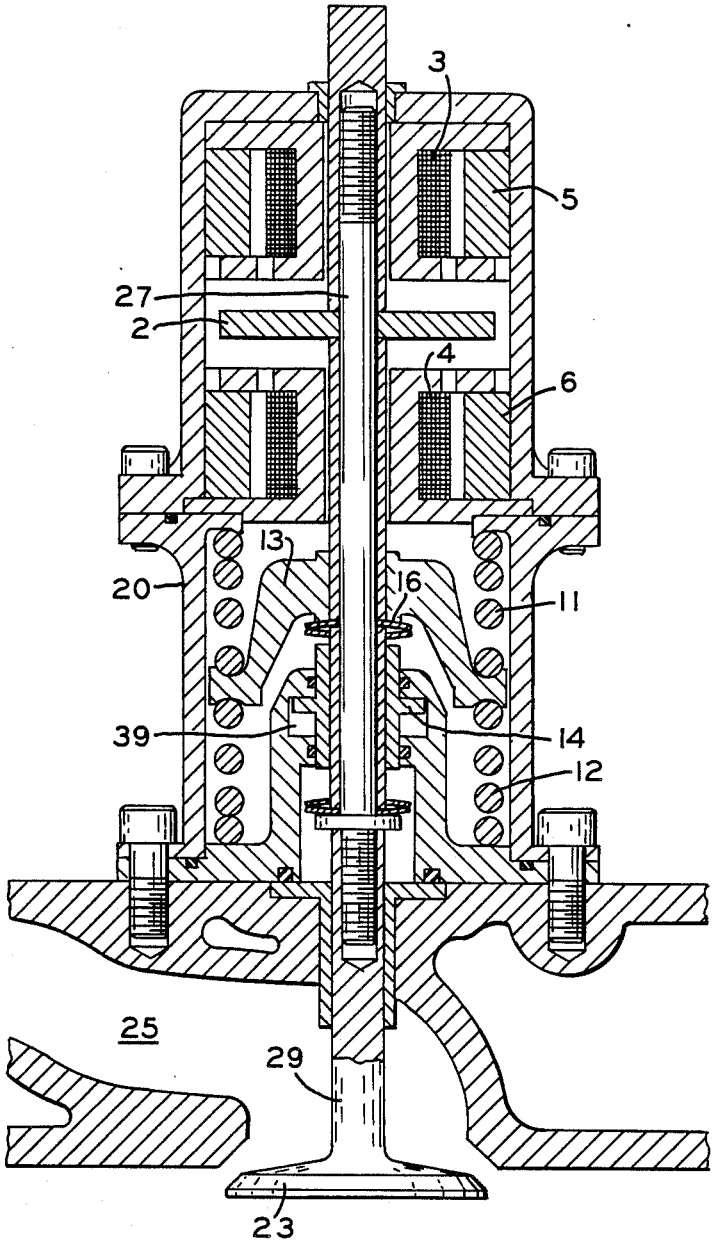
FIG. 2 is a view similar to FIG. 1, but showing the mechanism midway between valve-closed and valve-open positions.
Figure 3:
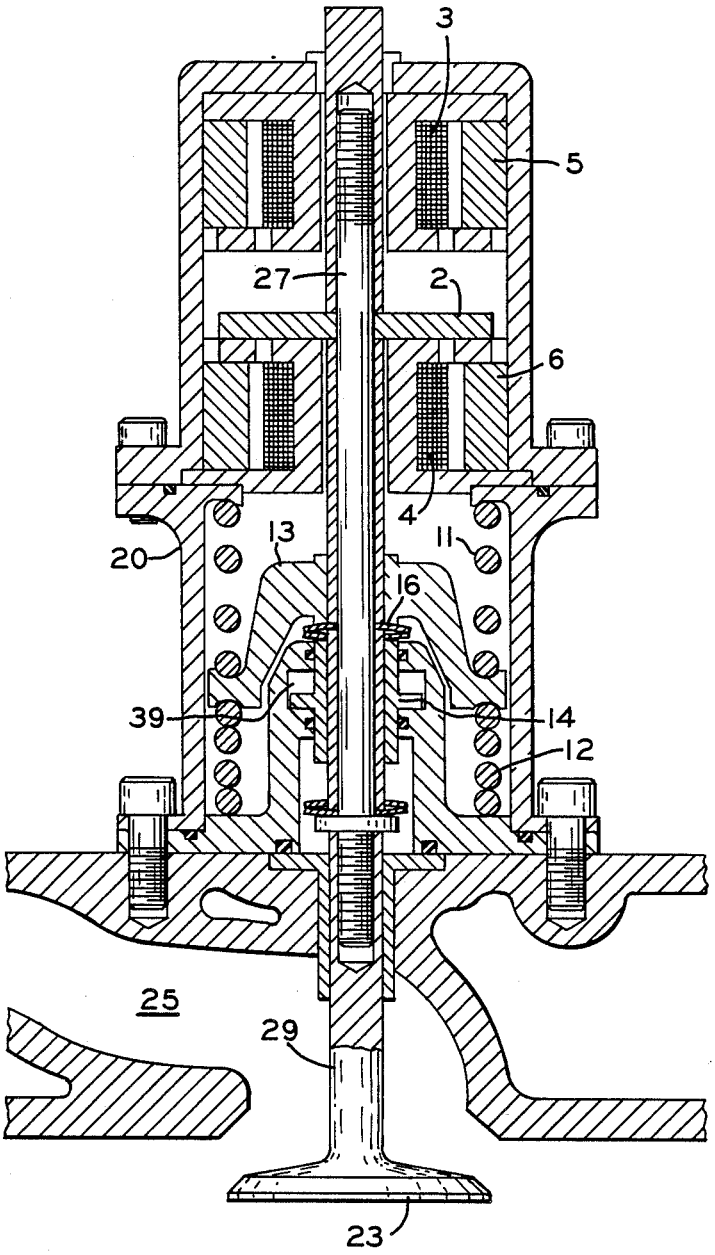
FIG. 3 is a view similar to FIGS. 1 and 2, but showing the mechanism in the valve-open position.
Figure 4:
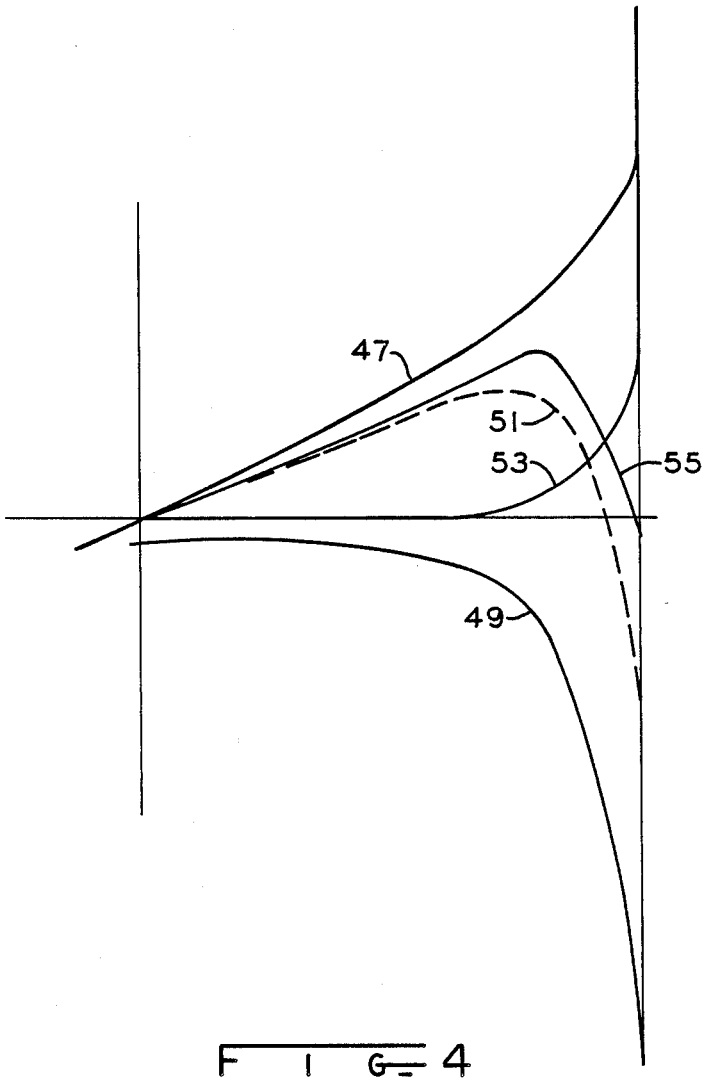
FIG. 4 illustrates the forces acting on the mechanism when moving between the positions shown in FIGS. 2 and 3.

FIG. 4 illustrates the various forces acting on the armature 27 in transitioning between the positions of FIGS. 2 and 3. Line 47 shows the increasing potential energy being stored in the spring. The spring approximately obeys Hooke's law with the retarding force increasing about linearly with displacement. Actually, this force increases somewhat more than linearly near the end of the travel. The force of attraction between the permanent magnet and the disk 2 is shown by line 49 and obeys an inverse square law increasing significantly as the disk nears the magnet. The precise shape of curve 49 depends on the particular geometry including the size of the air gap. The two forces are, of course, in opposite directions. The resultant of these two forces is shown by line 51 illustrating that the magnet overpowers the spring near the end of the travel.

As the armature nears one of its extreme positions, say the valve-open position, washer 16 engages the small reciprocable piston 14 moving that piston downwardly within the oil filled chamber 39 to provide a significant retarding of damping force on the armature. This damping force is illustrated by curve 53 in FIG. 4. The resultant of the spring, magnetic and damping forces is illustrated by the curve 55 in FIG. 4 showing only a slight net force on the armature near the end of its travel insuring that the plate or disk gracefully slows to a stop and latches with the magnet.

There is, of course, energy input to the system in the form of current pumped into one of the coils 3 or 4 nullifying the effect of one of the permanent magnets 5 or 6 to help power the system and make up for losses such as windage, damping and friction. With one latching magnet nullified, there is an additional translation force induced by the receiving magnet whose magnitude of attraction increases as the armature nears the magnet.

Figure 5:
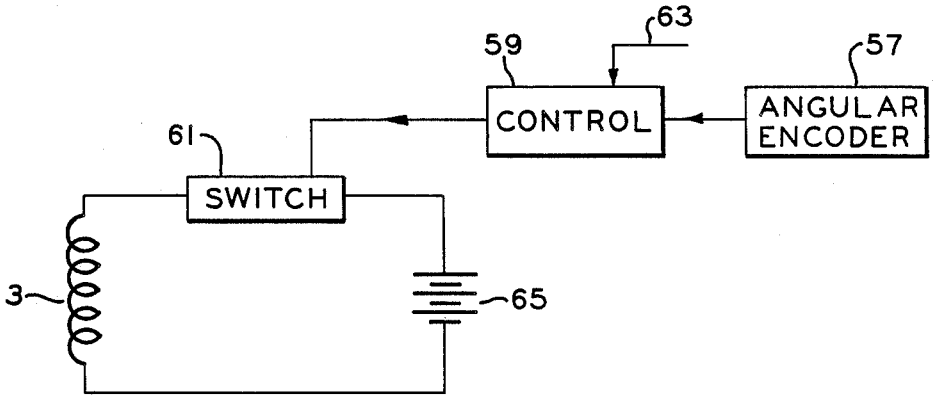
FIG. 5 is a schematic diagram of control circuitry for unlatching the permanent magnet latching arrangements in FIGS. 1–3.

Electromagnetic initiation of valve transition by the transducer may be accomplished in a wide variety of ways as shown in the above referenced copending applications. One scheme for supplying an electrical pulse to coil 3, for example, is shown in FIG. 5. An angular encoder 57 provides signals indicative of the angular position of the engine crankshaft and may, for example, include an optical or magnetic sensor for providing a predetermined number of pulses for each engine revolution. A control 59 counts the pulses (from a reference position) and provides an output to temporarily enable the switching device 61 upon reaching a predetermined count. The predetermined count may be modified in accordance with engine operating parameters, such as speed, as indicated by input 63. When the switching device 61 closes, a pulse is supplied from an electrical source such as the vehicle battery 65 to the coil. The other coils may be similarly enabled.

In FIG. 6, a pneumatic spring assembly has been substituted for the mechanical spring of FIGS. 1–3. In this embodiment, the entire pneumatic spring assembly and damper has been incorporated into and made a part of the latching module. The latching disk 2 of FIGS. 1–3 provided only the latching function. The disk 41 of FIG. 6 provides the latching function as previously discussed as well as functioning as a nonlinear, low mass pneumatic spring, and as a damping device to effectively slow the armature as the valve nears either of its two extreme positions.

The latching disk 41 has a circular seal 42 which keeps the upper pressure chamber 40 sealed relative to the lower pressure chamber 44. Chambers 40 and 44 are also utilized as "bounce" chambers in which the air is trapped and compressed as the latching disk 41 nears and then latches with one of the magnetic latches. The compressed air in the chambers provides the stored potential energy and accelerating force on the disk after unlatching which was provided by the springs in the embodiment of FIGS. 1–3. A motion damping provision is also included to slow the armature motion as disk 41 approaches one of the magnetic latches. A circular seal 45 contacts disk 41 a short distance before latching occurs and a small quantity of air is trapped between the disk and the magnet assembly. This small quantity of air is compressed to a pressure exceeding that in chamber 40 (or 44) and vented into that chamber through several small orifices such as 35 and 37 at a controlled rate. This throttling loss provides a controlled slowing of the valve shaft to an acceptable low impact velocity prior to latching. Some small air leakage will occur in the system and air supply fitting 43 includes a one-way valve which allows air to enter either chamber (depending on the position of piston 41) to replenish the air within the chambers. Air pressure to the fitting 43 can be controlled to easily change the "spring" rates.

From the foregoing disclosure, those skilled in the art will devise many adaptations, modifications and uses for the present invention beyond those herein disclosed yet within the scope of the present invention as set forth in the claims which follow.

What is claimed is:

1. An electronically controllable valve mechanism for use in an internal combustion engine comprising:

an engine valve having an elongated valve stem;

motive means comprising a housing, a piston coupled to the valve and air compressed by the piston within the housing for causing the valves to move in the direction of stem elongation between valve-open and valve-closed positions;

magnetic latching means including said piston for holding the valve in each of the valve-open and valve-closed positions; and means for releasing the magnetic latching means allowing the motive means to move the valve.

2. A bistable electronically controlled transducer having an armature reciprocable between first and second positions, a permanent magnet latching arrangement for holding the armature in one of said positions, motive means for continuously urging the armature away from the position in which it is maintained by the latching arrangement including a housing, a piston coupled to the armature and air compressed by the piston within the housing, and an electromagnetic arrangement for temporarily neutralizing the effect of the permanent magnet latching arrangement to release the armature to move from one of said positions to the other of said positions, and pneumatic means including a seal for contacting said piston only as the armature nears the other of said positions to significantly slow armature movement.

3. The bistable electronically controlled transducer of claim 2 wherein the permanent magnet latching arrangement includes the piston.

* * * * *